US009764187B1

(12) United States Patent
Stearns et al.

(10) Patent No.: US 9,764,187 B1
(45) **Date of Patent: *Sep. 19, 2017**

(54) EXERCISE METHODS AND APPARATUS

(76) Inventors: Kenneth W Stearns, Houston, TX (US); Joseph D. Maresh, West Linn, OR (US)

( * ) Notice: Subject to any disclaimer, the term of this patent is extended or adjusted under 35 U.S.C. 154(b) by 386 days.

This patent is subject to a terminal disclaimer.

(21) Appl. No.: 13/308,538

(22) Filed: Nov. 30, 2011

Related U.S. Application Data

(60) Provisional application No. 61/458,693, filed on Nov. 30, 2010.

(51) Int. Cl.
*A63B 22/04* (2006.01)
*A63B 22/06* (2006.01)
*A63B 21/02* (2006.01)

(52) U.S. Cl.
CPC ..... *A63B 22/0664* (2013.01); *A63B 21/026* (2013.01); *A63B 22/06* (2013.01); *A63B 2022/067* (2013.01)

(58) Field of Classification Search
CPC ..... A63B 22/0664; A63B 2022/067; A63B 2022/0676
USPC ..... 482/51–53, 57, 62, 70, 71, 79, 80, 148
See application file for complete search history.

(56) References Cited

U.S. PATENT DOCUMENTS

| | | | | |
|---|---|---|---|---|
| 5,507,710 | A * | 4/1996 | Chen | 482/72 |
| 6,080,086 | A * | 6/2000 | Maresh et al. | 482/57 |
| 6,206,804 | B1 * | 3/2001 | Maresh | 482/52 |
| 6,620,079 | B2 * | 9/2003 | Kuo | 482/51 |
| 6,645,125 | B1 * | 11/2003 | Stearns et al. | 482/52 |
| 6,672,992 | B1 * | 1/2004 | Lo et al. | 482/52 |
| 7,041,036 | B1 * | 5/2006 | Kuo | 482/52 |
| 7,608,019 | B1 * | 10/2009 | Stearns et al. | 482/52 |
| 7,811,207 | B2 * | 10/2010 | Stearns et al. | 482/52 |
| 7,981,001 | B2 | 7/2011 | Stearns et al. | |
| 8,147,384 | B2 * | 4/2012 | Stearns et al. | 482/52 |
| 8,449,437 | B1 * | 5/2013 | Maresh et al. | 482/52 |
| 8,852,059 | B1 * | 10/2014 | Stearns et al. | 482/52 |
| 2002/0119867 | A1 * | 8/2002 | Stearns et al. | 482/52 |
| 2004/0214693 | A1 * | 10/2004 | Piaget et al. | 482/52 |
| 2008/0261778 | A1 * | 10/2008 | Chuang et al. | 482/52 |
| 2010/0248899 | A1 * | 9/2010 | Bedell et al. | 482/4 |

* cited by examiner

*Primary Examiner* — Loan H Thanh
*Assistant Examiner* — Gregory Winter
(74) *Attorney, Agent, or Firm* — Nick A. Nichols, Jr.

(57) ABSTRACT

A variable stride exercise apparatus may provide a novel linkage assembly and corresponding exercise apparatus suitable for linking circular motion to relatively more complex, generally elliptical motion. Left and right cranks are rotatably mounted on a frame. A foot supporting linkage is movably connected between a rocker and the left and right cranks in such a manner that may provide a variable paths of motion controlled by a user of the apparatus.

12 Claims, 16 Drawing Sheets

EXERCISE METHODS AND APPARATUS

CROSS-REFERENCE TO RELATED APPLICATION

This application claims the benefit of U.S. Provisional Application Ser. No. 61/458,693, filed Nov. 30, 2010, which application is incorporated herein by reference.

BACKGROUND OF THE INVENTION

The present invention relates to fitness machines, and in particular to fitness machines which constrain the user's foot and/or arm to travel along a variable or fixed foot path.

Exercise equipment has been designed to facilitate a variety of exercise motions (including treadmills for walking or running in place; stepper machines for climbing in place; bicycle machines for pedaling in place; and other machines for skating and/or striding in place). Yet another type of exercise equipment has been designed to facilitate relatively more complicated exercise motions and/or to better simulate real life activity. Such equipment converts a relatively simple motion, such as circular, into a relatively more complex motion, such as elliptical. Despite various advances in the elliptical exercise category, there remains room for improvement.

SUMMARY OF THE INVENTION

A variable stride exercise apparatus may provide a novel linkage assembly and corresponding exercise apparatus suitable for linking circular motion to relatively more complex, generally elliptical motion. The apparatus may include a frame designed to rest upon a flat surface. Rocker links may be rotatably mounted on respective sides of the frame in spaced relationship with crank disks rotatably mounted on respective sides of the frame. Foot supporting linkages may be movably connected between the rocker links and respective crank disks in such a manner that may provide variable paths of motion controlled by a user of the apparatus.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION OF A PREFERRED EMBODIMENT

Figure 1:
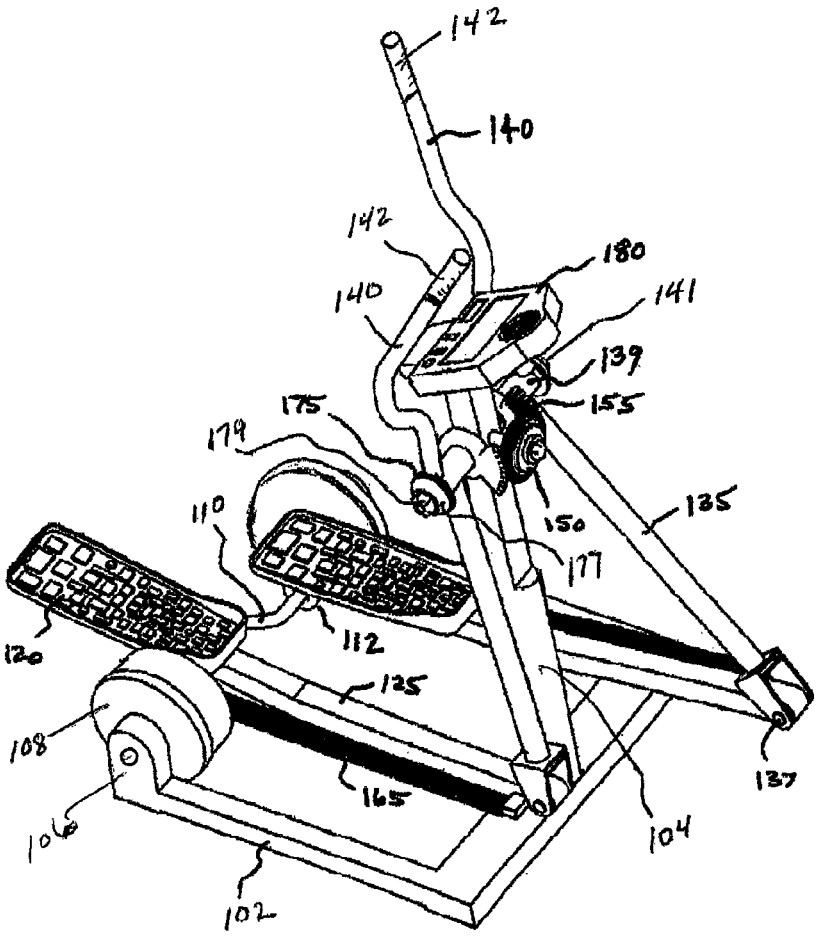
FIG. 1 is a perspective view of a first embodiment of an exercise apparatus.

Elliptical motion exercise apparatus may link rotation of left and right cranks to generally elliptical motion of respective left and right foot supports. The term "elliptical motion" is intended in a broad sense to describe a closed path of motion having a relatively longer major axis and a relatively shorter minor axis. In general, elliptical motion exercise apparatus may be said to use displacement of the cranks to move the foot supports in a direction coincidental with one axis of the elliptical path, and displacement of crank driven members to move the foot supports in a direction coincidental with the other axis. A general characteristic of such exercise apparatus is that the crank diameter determines the length of one axis, but does not determine the length of the other axis. As a result of this feature, a person's feet may pass through a space between the cranks while nonetheless traveling through a generally elliptical path having a desirable aspect ratio, and the apparatus that embody this technology may be made relatively more compact, as well. The embodiments shown and/or described herein are generally symmetrical about a vertical plane extending lengthwise through a floor-engaging base (perpendicular to the transverse ends thereof). In general, the "right-hand" components are one hundred and eighty degrees out of phase relative to the "left-hand" components. However, like reference numerals are used to designate both the "right-hand" and "left-hand" parts, and when reference is made to one or more parts on only one side of an apparatus, it is to be understood that corresponding part(s) are disposed on the opposite side of the apparatus. Also, to the extent that reference is made to forward or rearward portions of an apparatus, it is to be understood that a person can typically exercise on such apparatus while facing in either direction relative to the linkage assembly.

Referring first to FIG. 1, a first embodiment of an exercise apparatus is generally identified by the reference numeral 100. The apparatus 100 includes a frame 102 that is designed to rest upon a floor surface. The frame 102 includes a stanchion 104 that extends upward from a forward end of the frame 102 and rearward stanchions 106 that extend upward proximate an opposite, rearward end of the frame 102.

Left and right crank disks 108 are rotatably mounted on respective sides of the frame 102 proximate the rear end of the frame 102. A crank 110 is interconnected between the crank disks 108. Left and right rollers 112 are rotatably mounted on the crank 110 for orbital movement about the crank disks 108. Both crank disks 108 are shown in the form of disks, but crank arms may be used in the alternative. An advantage of using a crank disk is that it may be more readily connected to any of various known inertia altering devices, including, for example, a motor, a "stepped up" flywheel, an adjustable braking mechanism, or various combinations thereof.

Left and right rocker links 135 are pivotally mounted on respective sides of the stanchion 104. Each rocker link 135 extends generally downward from a rocker hub 139 that is pivotally connected to a transverse rocker shaft 141 fixed proximate the upper end of the stanchion 104. Left and right handle bars 140 are pivotally mounted on respective sides of the stanchion 104. Each handle bar 140 is rigidly connected to respective rocker hubs 139 and extends generally upward from the rocker hub 139. The upper end of each handle bar 140 includes a hand grip 142.

Left and right longitudinal foot members 125 are pivotally connected to a lower distal end of a respective rocker link 135 at a connection point 137. A rear portion of each foot member 125 includes an underlying race region which is in contact with a respective roller 112 as the crank disks 108 rotate. A foot platform 120 is rigidly connected to each foot member 125.

A center bevel gear 150 is rotatably connected to a shaft 152 fixedly secured proximate the upper end of the stanchion 104. The bevel gear 150 engages with respective right and left rocker bevel gears 155 rigidly connected to respective rocker hubs 139 interconnecting the rocker links 135 to move in dependent fashion in opposite directions relative to one another.

On each side of the frame 102, a rearward distal end of an extension spring 165 is connected to a bearing rotatably mounted on the crank 110 concentric with the roller 112, and a forward distal end of the extension spring 165 is connected proximate the forward end of foot member 125. Alternatively, the forward distal end of the extension spring 165 may be connected at a point along the rocker link 135 between the rocker hub 139 and the lower distal end of the rocker link 135. Adjustable friction disks 175 may be mounted about the transverse rocker shaft 141 proximate the distal ends thereof. The friction disks 175 may be mounted between the rocker hubs 139 and a cover 177 in facing contact with the friction disks 175. A knob 179 threadably mounted on each distal end of the rocker shaft 141 may be adjusted to introduce resistance to the pivotal motion of the rocker links 135, as desired.

Each extension spring 165 operates under tension throughout the stride length as the crank 110 rotates. During use, the extension spring 165 aids in rotating the crank 110 in the direction of the force applied by the user on the foot platform 120. For example, in the absence of the extension spring 165 and assuming that the crank 110 is rotating in a clockwise direction, as the crank 110 approaches the 12 o'clock or vertical position, a forward/downward force applied to the foot platform 120 may cause the crank 110 to stall or change to a counter clockwise rotation. The tension force applied by the extension spring 165 forces the crank 110 to continue its clockwise rotation.

Figure 2:
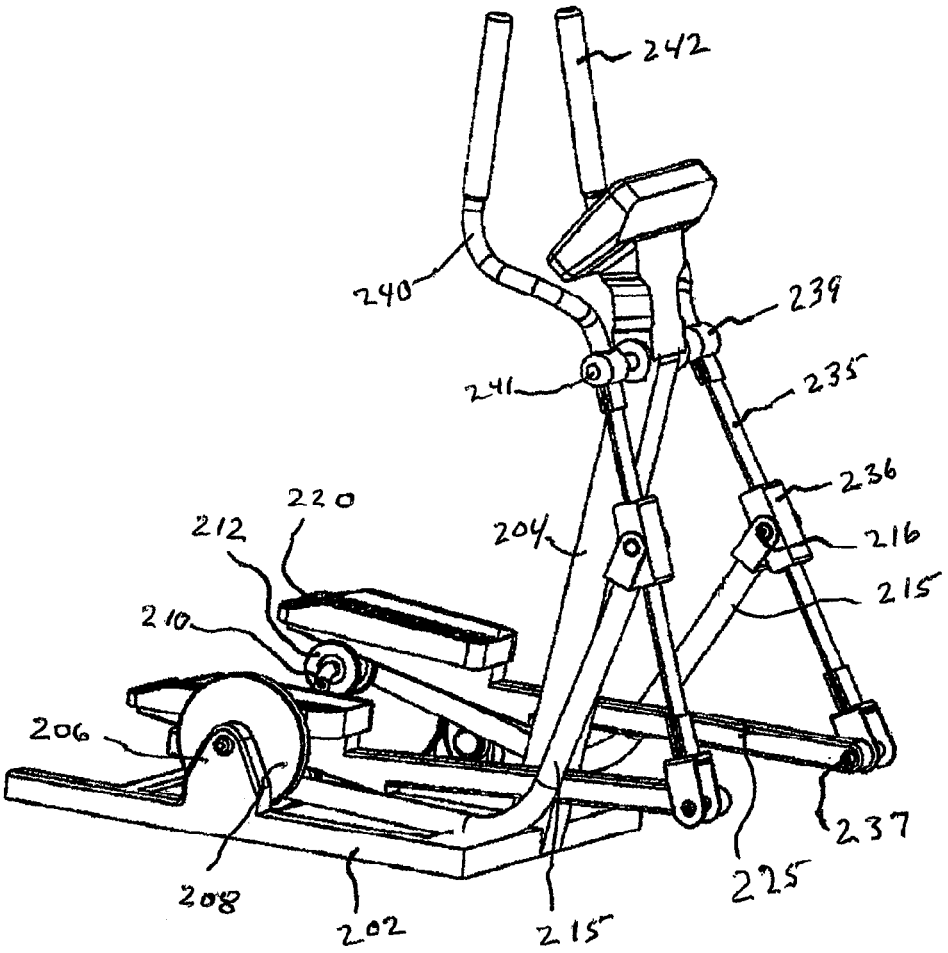
FIG. 2 is a perspective view of a second embodiment of an exercise apparatus.

Directing attention now to FIG. 2, a second embodiment of an exercise apparatus is generally identified by the reference numeral 200. The apparatus 200 generally includes a frame 202 and a linkage assembly movably mounted on the frame 200. Generally, the linkage assembly encourages a force receiving link 225 to travel through an elliptical path of motion having a variable configuration controlled by the user.

The frame 202 includes a stanchion 204 that extends upward from a forward end of the frame 202, and rearward stanchions 206 that extend upward proximate an opposite, rearward end of the frame 202. On each side of the apparatus 200, the linkage assembly generally includes a rocker link 235, a force receiving link 225, a drawbar link 215, a crank 210 and a roller 212 rotatably mounted on the crank 210. Crank disks 208 are rotatably mounted on the frame 202 at respective rearward stanchions 206. The crank 210 may be interconnected between the crank disks 208 by means known in the art.

A rocker link 235 is pivotally mounted on respective sides of the stanchion 204. Each rocker link 235 may comprise a leaf spring that extends generally downward from a rocker hub 239 that is pivotally connected to a transverse rocker shaft 241 fixed proximate the upper end of the stanchion 204. Left and right handle bars 240 are pivotally mounted on respective sides of the stanchion 104. Each handle bar 240 is rigidly connected to a respective rocker hub 239 and extends generally upward from the rocker hub 239. The upper end of each handle bar 240 includes a hand grip 242.

On each side of the apparatus 200, a rearward distal end of the drawbar link 215 is rotatably connected to the crank 210, and a forward distal end of the drawbar link 215 is pivotally connected to a slide bracket 236 at a connection point 216. The bracket 236 may be a clamp or the like that is movably mounted on the rocker link 235.

Referring still to FIG. 2, a forward distal end of the force receiving link 225 is pivotally connected to a lower distal end of the rocker link 235 at connection point 237, and a rearward portion of the force receiving link 225 is in rolling contact with the crank roller 212. During use, the foot path and/or arm path configuration is a function of the force applied by the user to lengthen or shorten the foot path and/or arm path. In the configuration shown in FIG. 2, a sufficient force to overcome the bending moment of the leaf spring rocker link 235 applied by the user to the foot platforms 220 in a longitudinal direction deflects the lower portion of the rocker link 235 below the slide bracket 236 in the direction of the applied force, i.e., forward or backward, resulting in a variable stride length. Likewise, the user may alter the arm path by applying a force to the handle bars 240 sufficient to deflect the upper portion of the leaf spring rocker link 235 above the slide bracket 236 in the direction of the force applied to the handle bars 240, i.e., away from or toward the user.

Figure 3A:
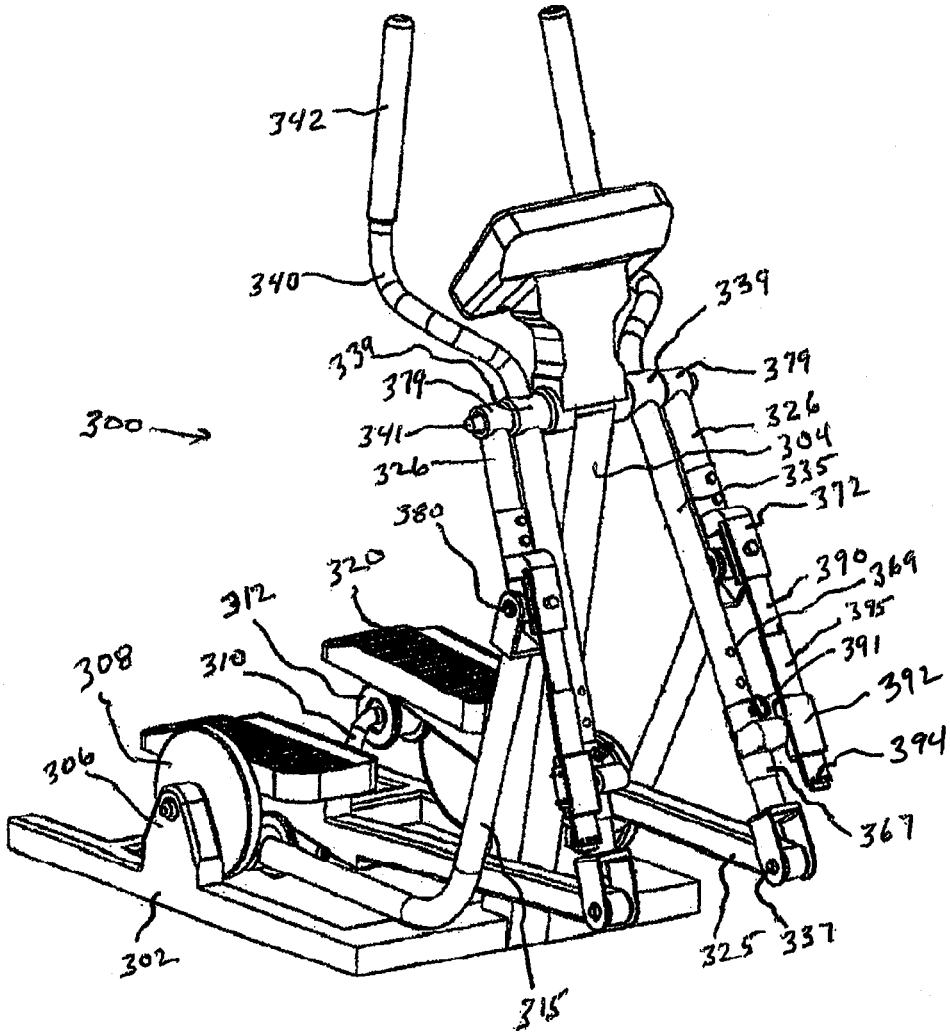
FIGS. 3A and 3B are perspective views of a third embodiment of an exercise apparatus.
Figure 3B:
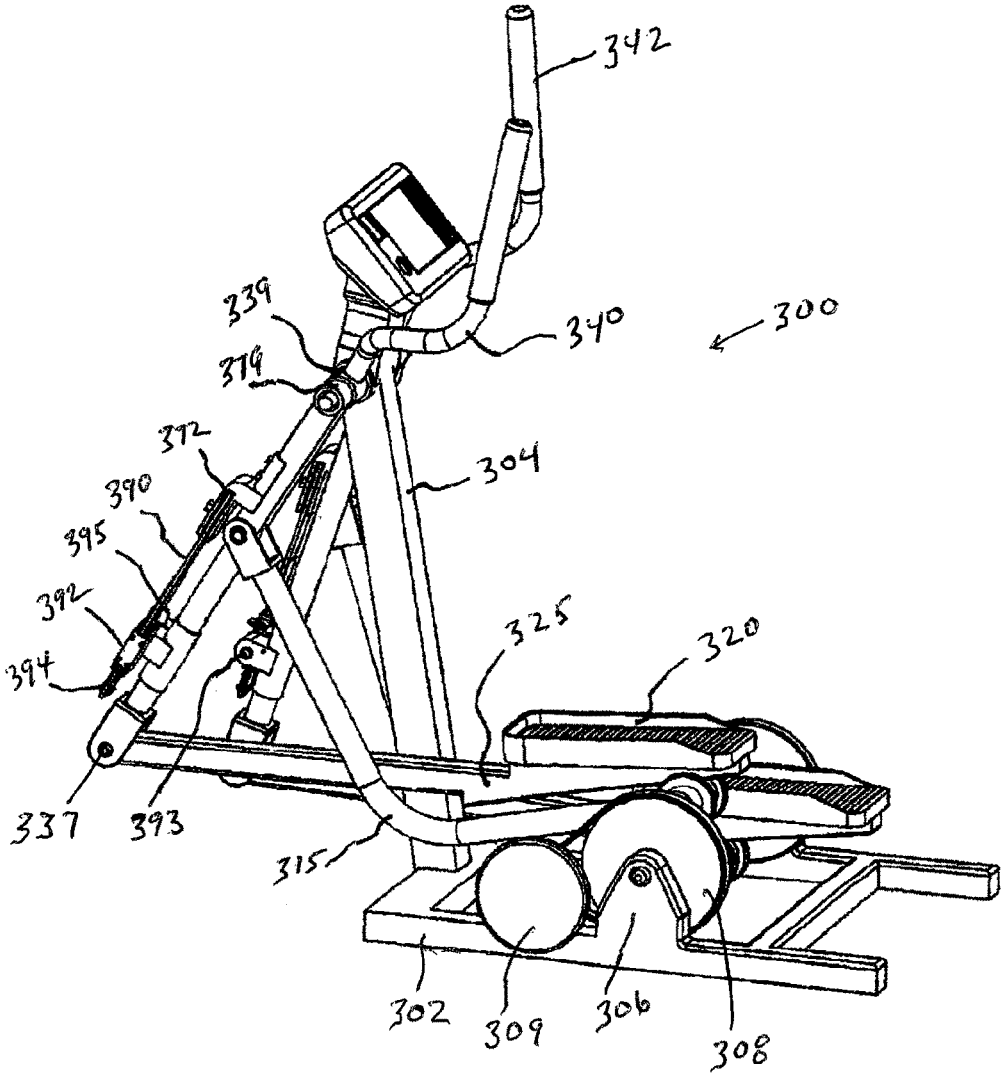
Figure 3C:
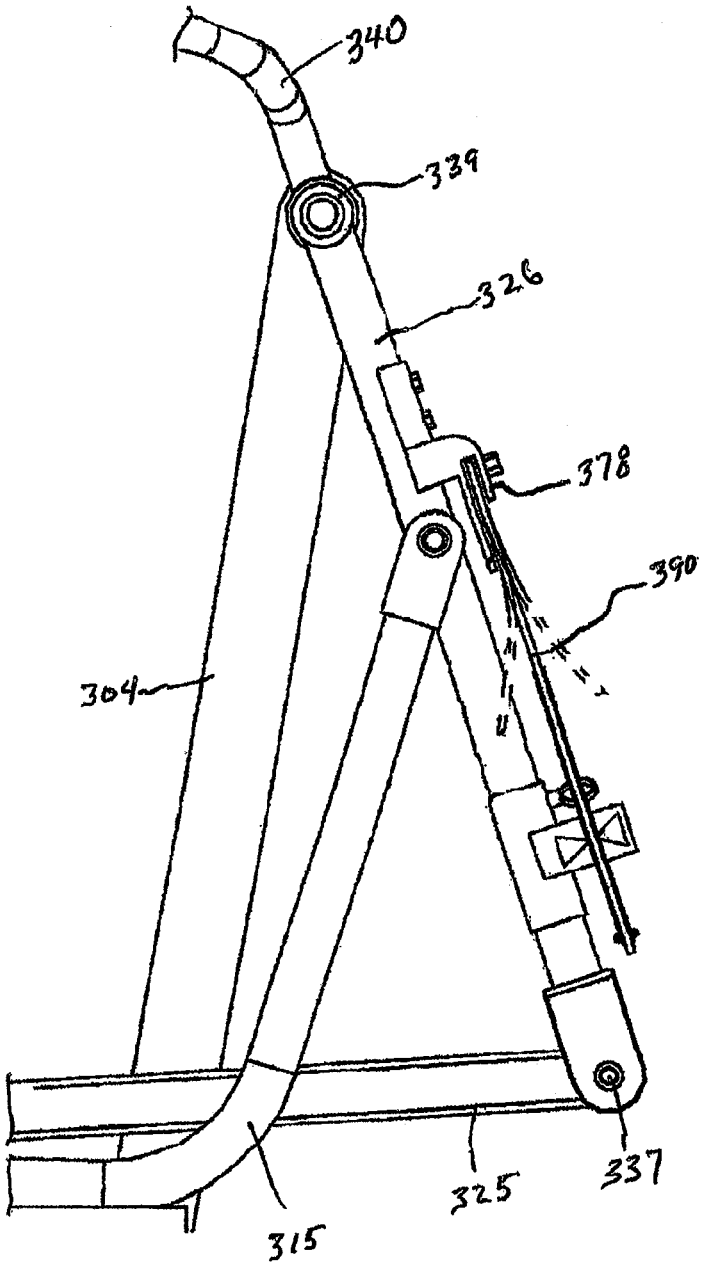
FIG. 3C is a partial side view of the third embodiment of the exercise apparatus shown in FIG. 3A.

Referring now to FIGS. 3A-3C, a third embodiment of an exercise apparatus is generally identified by the reference numeral 300. The apparatus 300 generally includes a frame 302 and a linkage assembly movably mounted on the frame 300. Generally, the linkage assembly encourages a force receiving member 325 to travel through an elliptical path of motion having a variable configuration controlled by the user.

The frame 302 includes a stanchion 304 that extends upward from a forward end of the frame 302, and a rearward stanchion 306 that extends upward proximate an opposite, rearward end on each side of the frame 302. On each side of the apparatus 300, the linkage assembly generally includes a rocker link 335, a force receiving link 325, a drawbar rocker link 326, a drawbar link 315, a crank 310 and a roller 312 rotatably mounted on the crank 310. Crank disks 308 are rotatably mounted on the frame 302 at respective rearward stanchions 306. The crank 310 may be interconnected between the crank disks 308 by means known in the art. The crank 310 may be connected to any of various known inertia altering devices, such as a flywheel 309, to provide resistance to rotation.

A rocker link 335 is pivotally mounted on respective sides of the stanchion 304. Each rocker link 335 extends generally downward from a rocker hub 339 that is pivotally connected to a transverse rocker shaft 341 fixed proximate the upper end of the stanchion 304. Left and right handle bars 340 are pivotally mounted on respective sides of the stanchion 304. Each handle bar 340 is rigidly connected to a respective rocker hub 339 and extends generally upward from the rocker hub 339. The upper end of each handle bar 340 includes a hand grip 342.

A drawbar rocker 326 is rotatably mounted on respective sides of the stanchion 304. Each drawbar rocker 326 extends generally downward from a drawbar rocker hub 379 that is pivotally connected to the transverse rocker shaft 341. An upper end of a leaf spring 390 is fixedly secured to the drawbar rocker 326 at a lower end thereof by a clamp 372 or the like. The leaf spring 390 extends downwardly from the drawbar rocker 326 and is connected proximate the lower end of the rocker link 335 by a slide clamp 392. The slide clamp 392 is secured slidably mounted proximate the lower end of the leaf spring 390. The slide clamp 392 is pivotally connected to a bracket 367 movably mounted proximate the lower end of the rocker link 335 by a pivot shaft 393. The location of the bracket 367 may be adjusted along the lower portion of the rocker link 335. The rocker link 335 is provided with spaced holes 369 that may be aligned with a hole 371 formed in the bracket 367. A removable pin 391 inserted through the aligned holes 369 and 371 secures the bracket 367 to the rocker link 335. The moment arm to which the leaf spring 390 is subjected may be altered by adjustment of the bracket 367, and consequently the slide clamp 392, up or down relative to the rocker link 335 and leaf spring 390, respectively. A change in the moment arm of the leaf spring 390 changes the effect of a user applied force on the stride path and/or arm path.

Generally, the leaf spring 390 may be constructed of metal or nonmetallic materials. For example, the leaf spring 390 may comprise fiberglass strands within an epoxy matrix (alternatively, glass fibers within a nylon or a urethane matrix may be suitable, or the leaf spring may be constructed of wood or metal). For a leaf spring 390 of fiberglass construction (or other abrade-able material such as wood or various plastics), the fiberglass material may be shielded from abrasive contact at the region where relative movement occurs between the slide clamp 392 and the leaf spring 390, by covering the front and rear surfaces of the leaf spring 390 with a thin, low friction sheath 395 disposed between the leaf spring 390 and the slide clamp 392. Bolts 394 or the like secure the sheath 395 to the leaf spring 390. The bolts 394 are located proximate the lower end of the leaf spring 390 so as not to interfere with the relative motion between the leaf spring 390 and the slide clamp 392.

Referring still to FIGS. 3A-3B, a rear distal end of the drawbar link 315 is rotatably connected to the crank 310, and a forward distal end thereof is pivotally connected to the drawbar rocker 326 at a connection point 380. Longitudinal force receiving link 325 is rotatably connected to a lower distal end of the rocker link 335 at connection point 337. A rearward portion of the force receiving link 325 includes a race on an underlying surface thereof in rolling contact with the crank roller 312. A foot platform 320 is rigidly secured proximate the rearward distal end of the force receiving link 325.

Figure 3D:
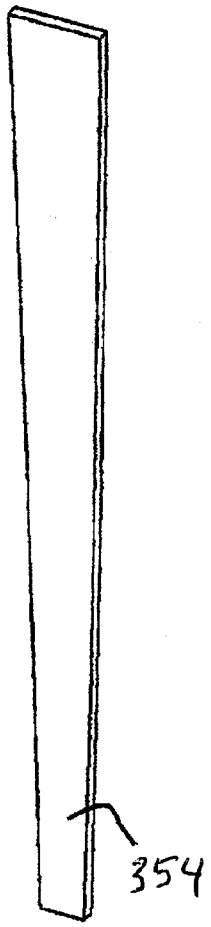
FIGS. 3D and 3E are perspective views of the tapered leaf springs shown in the exercise apparatus of FIG. 3A.
Figure 3E:
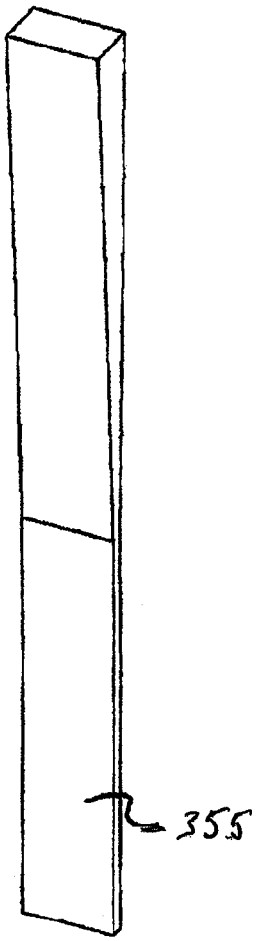

Referring now to FIGS. 3D and 3E, examples of a leaf spring construction are shown. Due to the progressive nature of the force deflection characteristics of the leaf spring, the spring taper may change relative to the neutral axis of the leaf spring. The taper of a leaf spring 354 pertains generally to the changing width from one end of the leaf spring 354 to the other end for any given moment load. The taper of the leaf spring 355 pertains generally to the changing thickness from one end of the leaf spring 355 to the other end for any given moment load.

Figure 4A:
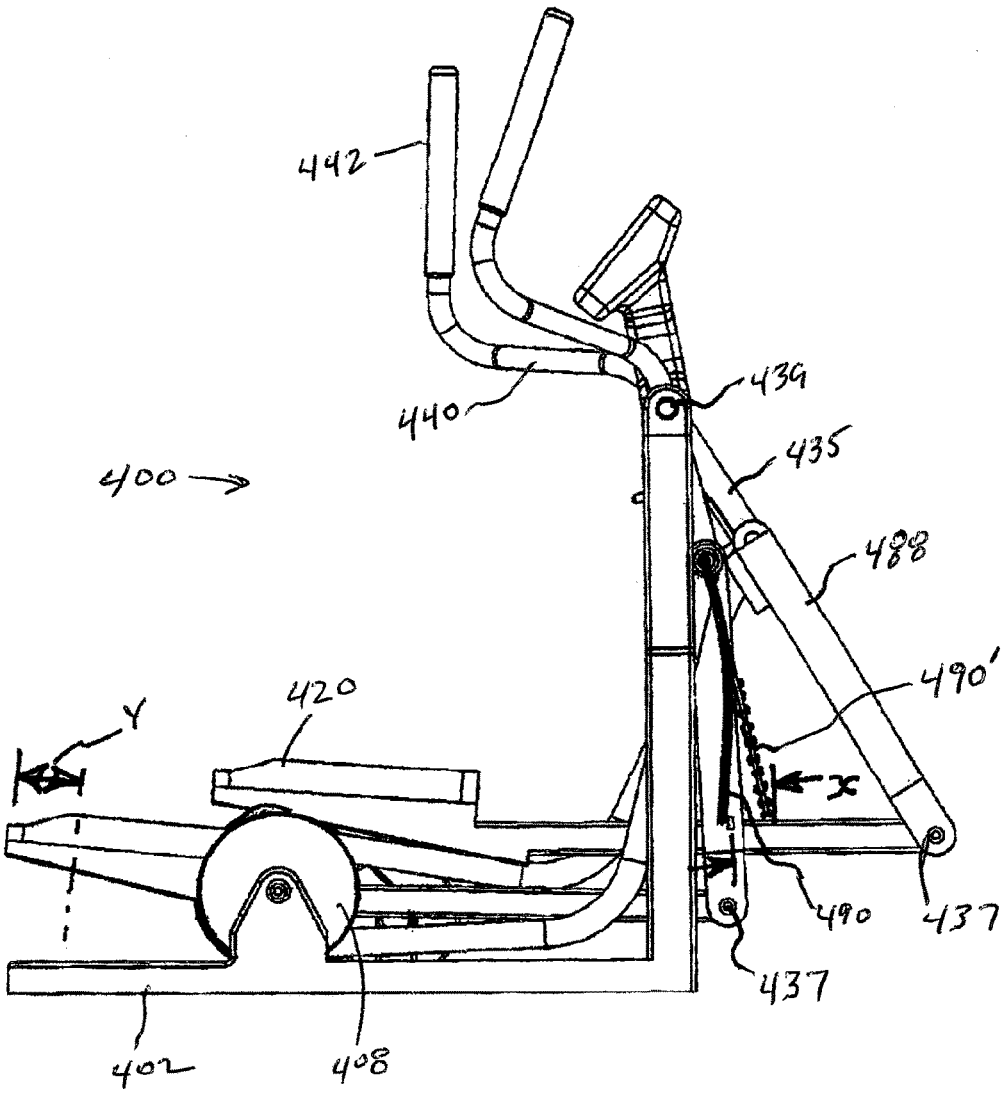
FIG. 4A is a perspective view of a fourth embodiment of an exercise apparatus.
Figure 4B:
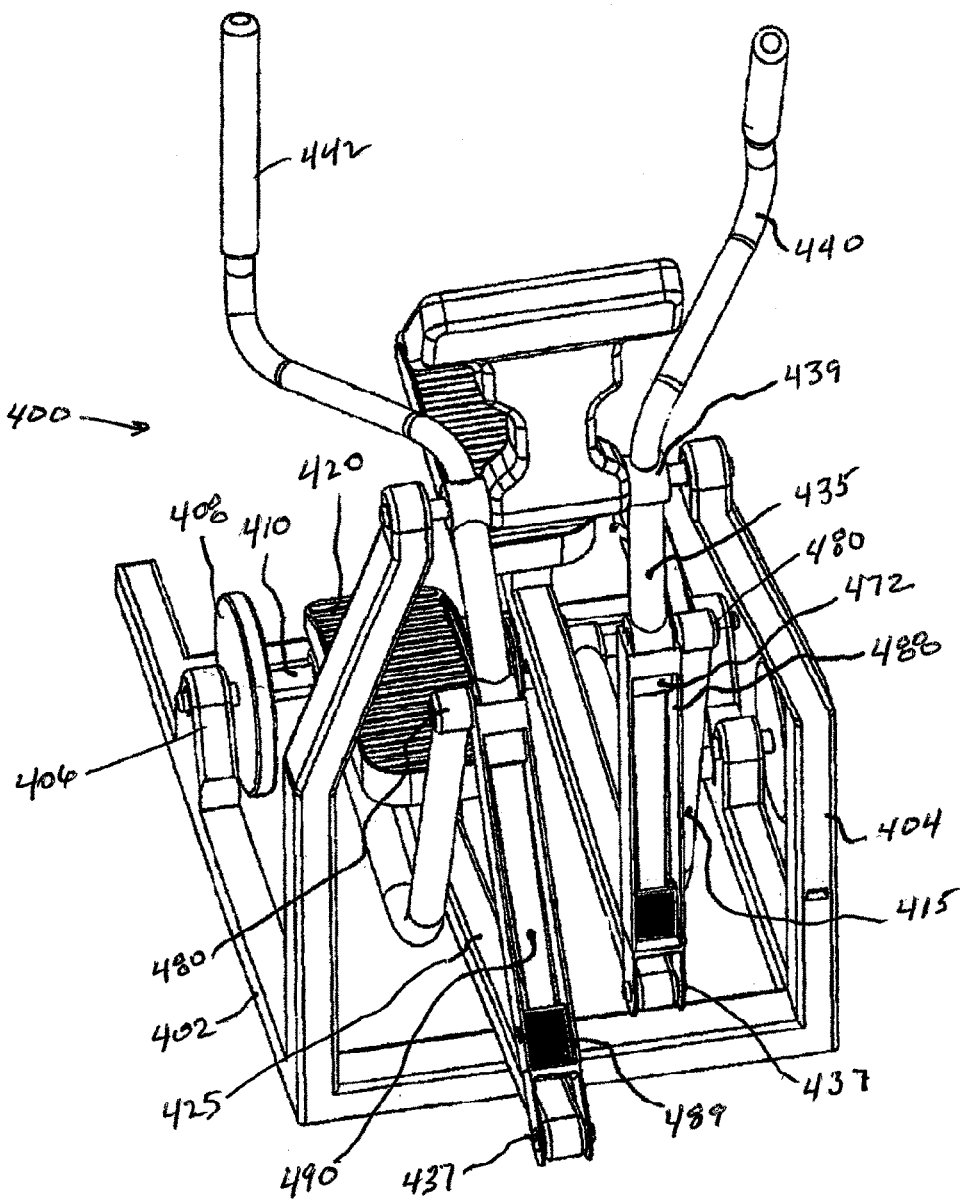
FIG. 4B is a side view partially broken away of the exercise apparatus shown in FIG. 4A.

Directing attention now to FIGS. 4A and 4B, a fourth embodiment of an exercise apparatus is generally identified by the reference numeral 400. The apparatus 400 is similar to the apparatus 300 described above with the exception that the arm path of the apparatus 400 is constant and the foot path is variable. The arm path distance is a function of the diameter of the orbital path of the crank 410 about the crank disks 408 axis and the foot path distance is a function of the user applied force against the foot platform 420.

Generally describing the components of the apparatus 400, a handle bar 440 is rigidly connected to a rocker link 435. A leaf spring housing 488 is pivotally connected to the rocker link 435 at connection point 480. The lower distal end of the leaf spring housing 488 is pivotally connected to a forward distal end of a foot support member 425 at connection point 437. An underlying portion of the rearward distal end of the foot support member 425 defines a race that is in rolling contact with a crank roller 412. An upper end of a leaf spring 490 is fixedly secured to the rocker link 435 at a clamp 472 and extends downwardly therefrom. The clamp 472 may be integrally formed with the rocker link 435. A lower end of the leaf spring 490 is in sliding engagement with a slide bracket 489 mounted proximate the lower end distal end of the leaf spring housing 488.

A rear distal end of a drawbar 415 is rotatably connected to a crank 410 and a forward distal end of the drawbar 415 is rotatably connected to the rocker link 435 and by extension to the handle bar 440 at connection point 480. The handle bar 440 is thus rotatably connected to the crank 410 and thereby the arm path distance is a function of the diameter of the orbital path of the crank 410 about the crank disks 408 axis.

Continuing now and referring to FIG. 4B, during use the lower end of the leaf spring 490 may be deflected by a longitudinal distance X as force is applied by the user to the foot platform 420 moving the foot support member 425 rearward and forward and causing the leaf spring housing 488 to pivot about the connection point 480. In the configuration shown in FIG. 4B, the deflection distance X of the leaf spring 490 corresponds to an increased foot stride length Y at the rearward distal end of the foot support member 425. If the user applied force is not sufficient to overcome the bending moment of the leaf spring 490, the leaf spring 490 maintains a substantially straight undeflected orientation, indicated as 490' in FIG. 4B.

Figure 5A:
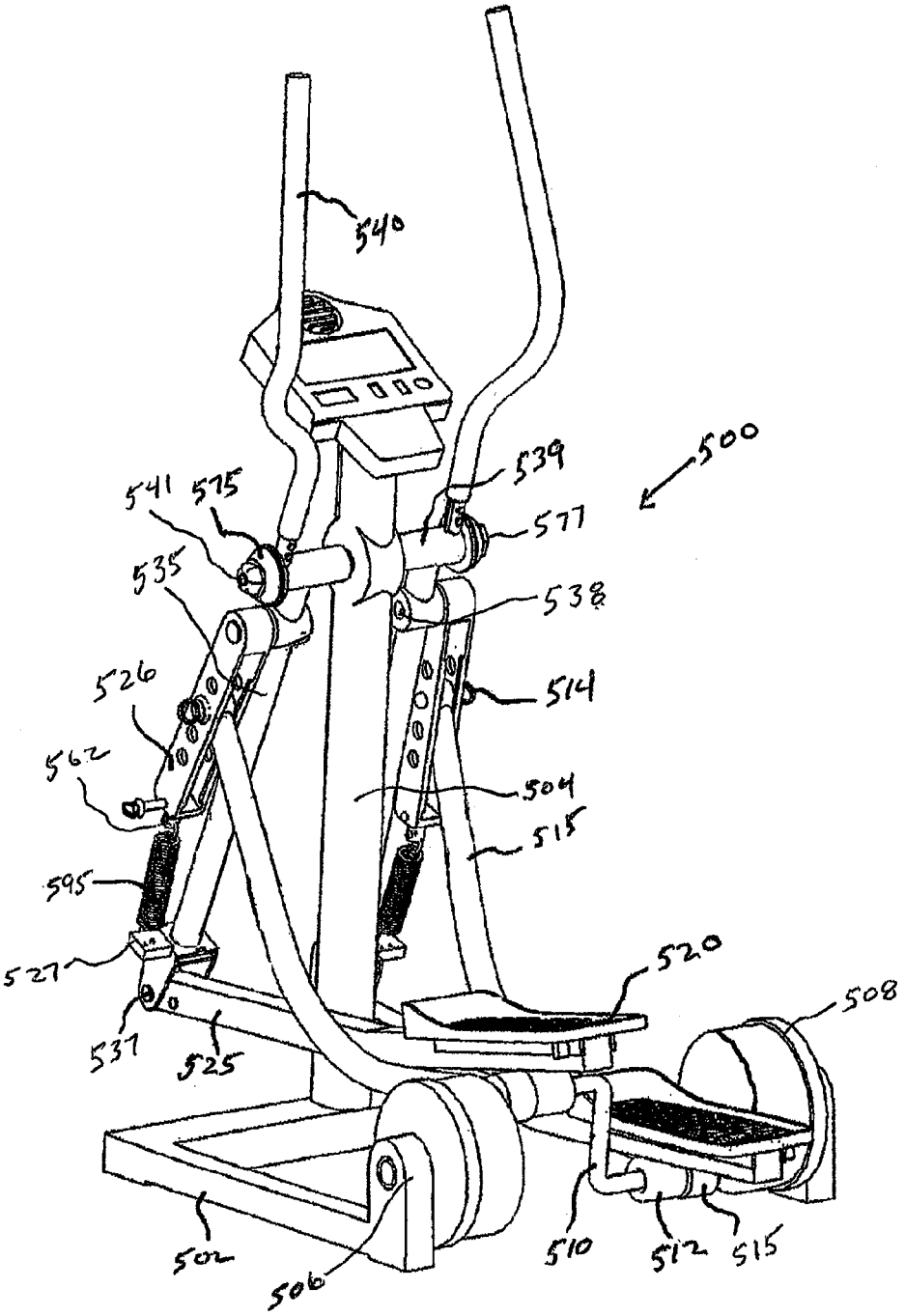
FIG. 5A is a perspective view of a fifth embodiment of an exercise apparatus.
Figure 5B:
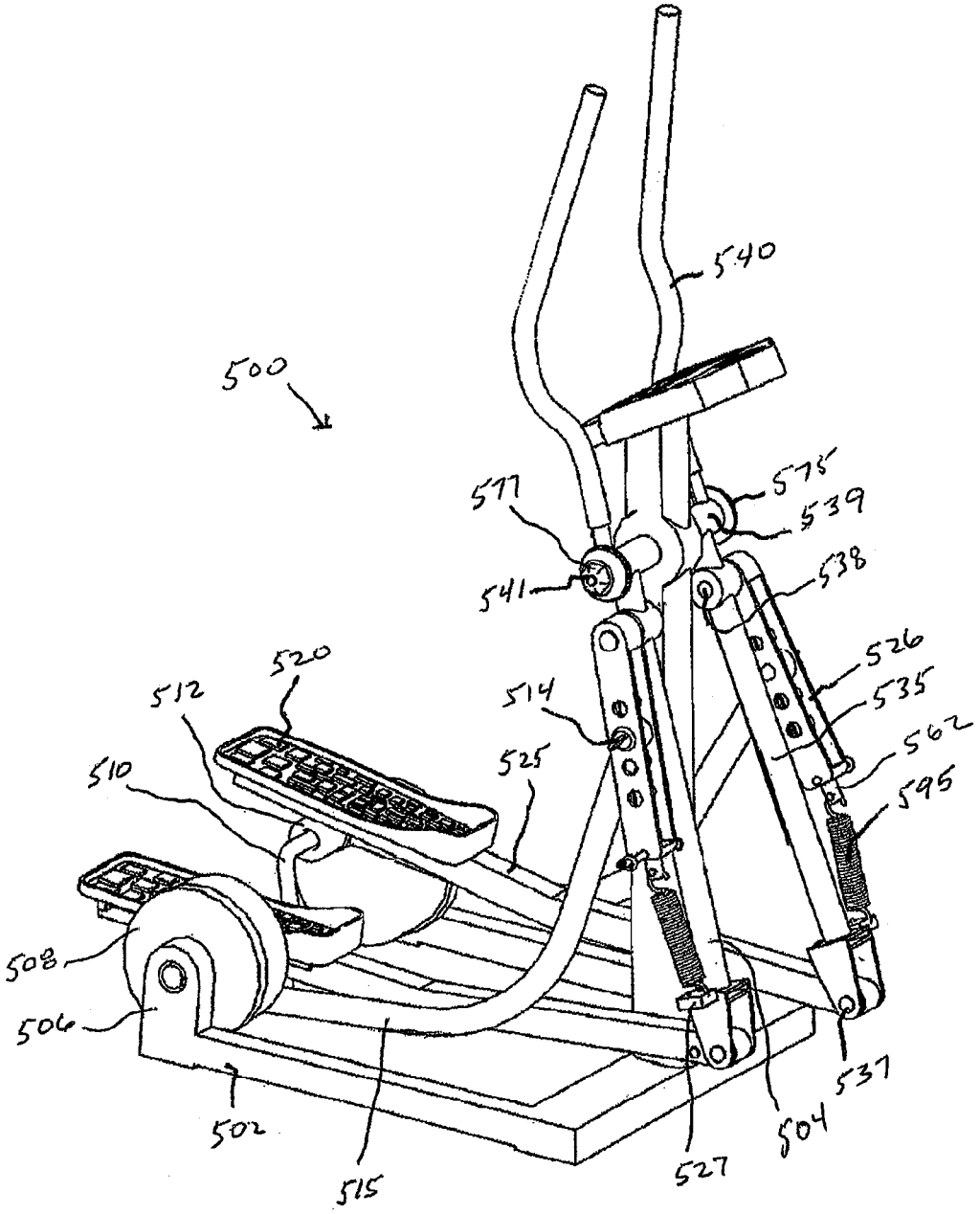
FIG. 5B is a perspective view from the front and side of the exercise apparatus shown in FIG. 5A.

Directing attention now to FIGS. 5A and 5B, a fifth embodiment of an exercise apparatus is generally identified by the reference numeral 500. The apparatus 500 is similar to the apparatus 400 described above with the exception that the variable paths of both the arm path and foot path of the apparatus 500 are a function of the user applied force to the handlebars and the foot platforms. The apparatus 500 generally includes a frame and a linkage assembly movably mounted on each side of the frame. Generally, the linkage assembly encourages a force receiving member to travel through an elliptical path of motion having a variable configuration controlled by the user.

A frame 502 of the apparatus 500 may include a stanchion 504 that extends upward from a forward end of the frame 502, and rearward stanchions 506 that extend upward in spaced relationship with one another proximate the rear end of the frame 502. On each side of the apparatus 500, the linkage assembly may include a rocker link 535, a force receiving member 525, a drawbar rocker link 526, a drawbar 515, a crank 510 and a roller 512 rotatably mounted on the crank 510. Each rocker link 535 extends generally downward from a rocker hub 539 that is pivotally connected to a transverse rocker shaft 541 fixed proximate the upper end of the stanchion 504. Crank disks 508 are rotatably mounted on the frame 502 at respective rearward stanchions 506. The crank 510 is interconnected between the crank disks 508 by means known in the art. The crank 510 may be connected to any of various known inertia altering devices, such as a flywheel, to provide resistance to rotation.

A resistance element, such as a rotatable friction disk 575, may be coupled to the handle bars 540. The friction disk 575 may provide generally longitudinal resistance. A knob 577 may be threadedly secured at the distal ends of the rocker shaft 541. The knob 577 engages the friction disk 575 so that tightening or loosening the knob 577 varies the resistance to rotational motion that is applied to the handle bars 540.

A rearward distal end of the drawbar 515 may be rotatably connected to the crank 510 concentric with the crank roller 512. A forward distal end of the drawbar 515 may be pivotally connected to the drawbar rocker 526 at pivot shaft 514. The forward end of the force receiving member 525 is pivotally connected to a lower distal end of the rocker link 535 at pivot shaft 537. An underlying rearward region of the force receiving member 525 is in rolling contact with the crank roller 512.

The drawbar rocker link 526 is pivotally connected to the rocker link 535 at bearing 538. It will be observed however that the drawbar rocker link 526 may alternatively be connected to the apparatus frame 502 collinear or non-collinear with the pivot axis defined by the rocker shaft 541.

Continuing with FIGS. 5A and 5B, an extension spring 595 may be disposed between the drawbar rocker link 526 and a lobe 527 fixed proximate the lower distal end of the rocker link 535. The lower end of the extension spring 595 may alternatively be connected to a relatively forward region of the force receiving member 525. The upper end of the extension spring 595 is connected to the lower distal end of the drawbar rocker link 526 at tab 562. The extension spring 595 is in tension at all times and functions to bias the drawbar rocker link 526 to a generally neutral orientation with respect to the force receiving member 525. During periods of user applied force at the handle bar 540 and/or the foot platform 520 that exceeds the tensile force of the spring 595, the drawbar rocker link 526 deviates from the neutral orientation and thereby permitting the user's hands and feet to travel through a larger or smaller path of motion. If the user applied force is in the direction of motion, the foot/hand path of motion will be larger. Conversely, if the user applied force is in a direction opposite the direction of motion, the foot/hand path motion distance will be smaller.

Figure 6A:
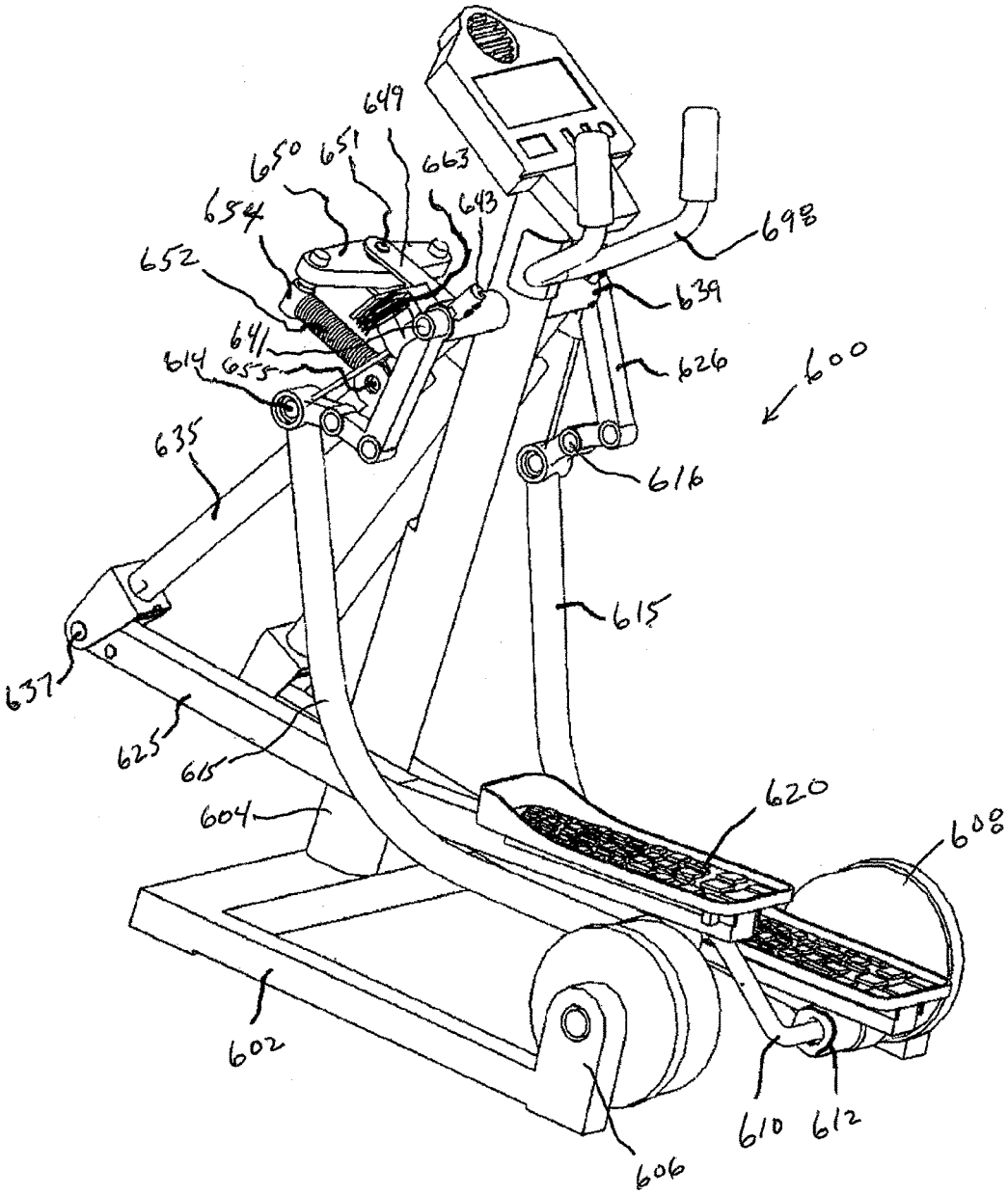
FIG. 6A is a perspective view of a sixth embodiment of an exercise apparatus.
Figure 6B:
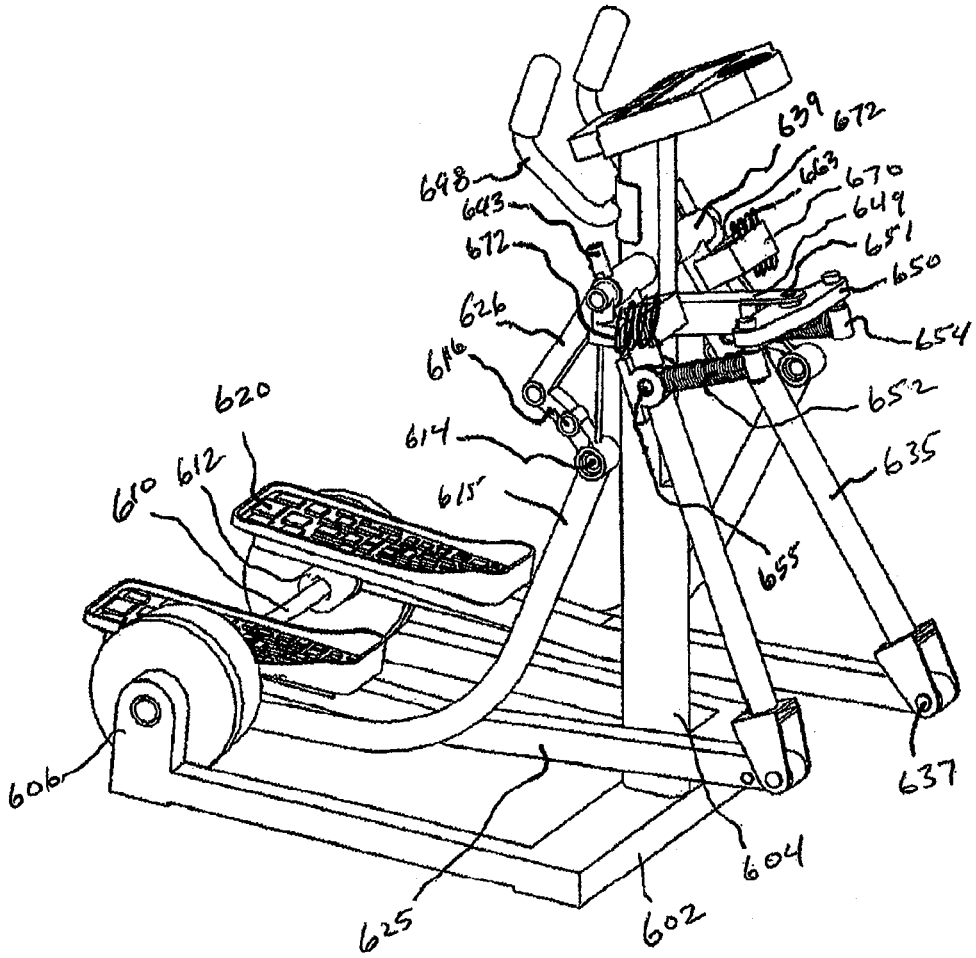
FIG. 6B is a perspective view from the front and side of the exercise apparatus shown in FIG. 6A.

Referring now to FIGS. 6A and 6B, a sixth embodiment of an exercise apparatus is generally identified by the reference numeral 600. The apparatus 600 may include a frame 602 designed to rest upon a flat surface, such as a floor or the like. A stanchion 604 extends upward from a forward end of the frame 602, and rearward stanchions 606 that are in spaced relationship to one another extend upward proximate a rear end of the frame 602. Linkage assemblies may be movably mounted on the frame 602. On each side of the apparatus 600, the linkage assembly may include a rocker link 635, a force receiving member 625, a drawbar rocker link 626, a drawbar 615, a crank 610 and a roller 612 rotatably mounted on the crank 610. Each rocker link 635 extends generally downward from a rocker hub 639 that is pivotally connected to a transverse rocker shaft 641 fixed proximate the upper end of the stanchion 604. A handle bar (not showing the drawings) may be rigidly connected to the rocker hub 639 at stud 643. Stationary hand grips 698 may be fixed to the stanchion 604 for grasping by a user when arm motion is not desired. Crank disks 608 are rotatably mounted on the frame 602 at respective rearward stanchions 606. The crank 610 is interconnected between the crank disks 608 by means known in the art. The crank disks 608 may be connected to any of various known inertia altering devices, such as a flywheel, to provide resistance to rotation.

Drawbar rocker link 626 is rotatably connected to the frame 602 about the rocker shaft 641 concentric with the rocker hub 639. It will be observed however that the drawbar rocker link 626 may alternatively be rotatably connected to either the rocker link 635 or the apparatus frame 602 at an axis not collinear with the axis defined by the rocker shaft 641. A rearward distal end of the drawbar 615 may be rotatably connected to the crank 610 concentric with the crank roller 612. A forward distal end of the drawbar 615 may be rotatably connected to the drawbar rocker link 626 at pivot joint 614.

The drawbar rocker link 626 may be configured generally in the shape of a triangle as shown in FIGS. 6A and 6B. It is understood however that the drawbar rocker link 626 is not limited to a triangular configuration but may take any other configuration, for example, as may be required for manufacturing the apparatus 600. The drawbar rocker link 626 may include a plurality of holes 616 along a lower portion thereof. General stroke range adjustments may be made to the apparatus 600 by changing the connection point of the drawbar 615 to any one of the holes 616 of the drawbar rocker link 626. Force receiving member 625 is rotatably connected to a lower distal end of the rocker link 635 at pivot pin 637. An underlying rearward region of the force receiving member 625 is in rolling contact with the crank roller 612.

The rocker links 635 are interconnected to move in dependent fashion in opposite directions relative to one another. A connector link 650 is mounted on a frame member 649 that is fixed to the forward stanchion 604. The frame member 649 extends in a generally forward direction from the stanchion 604, away from a user standing on the foot platforms 620. The connector link 650 is mounted proximate the distal end of the frame member 649 and is rotatable about a transverse axis defined by the bearing shaft 651. The distal ends of the connector link 650 are rotatably connected to the rocker links 635 at joints 654 and 655 by a force transmitting member. In the apparatus 600 the force transmitting member is a fully collapsed spring 652. A tensile member, such as a cable or chain, may be concentrically enclosed within the spring 652 to prevent the spring 652 from expanding while at the same time permitting the spring 652 to flex. To accommodate movement in two planes, the joints 654 and 655 may be ball joints, or alternatively may be planar bearings or the like.

Each rocker link 635 of the apparatus 600 may include a right angle flange 670 or similar structure fixedly secured proximate the upper end thereof. A flange 672 or the like is rigidly fixed to each drawbar rocker link 665 in spaced facing relationship with the flange 670 fixed to each rocker link 635. A spring 663 captured between the flanges 670 and 672 provides a biasing force between the rocker links 635 and drawbar rocker links 626.

During use of the apparatus 600, the stride length of the user may be variable as a function of user applied force at the handle bars and/or the foot platforms 620 depending on the deflection of the springs 663. It may be noted that springs 663 typically exert a force (tension or compression) and that periods of zero spring force are not necessary for neutral biasing because the cross-connect member 650 continually balances the spring forces from right to left. In other words, when a user is not on the apparatus 600, the springs 663 will balance and cancel each other.

Figure 7A:
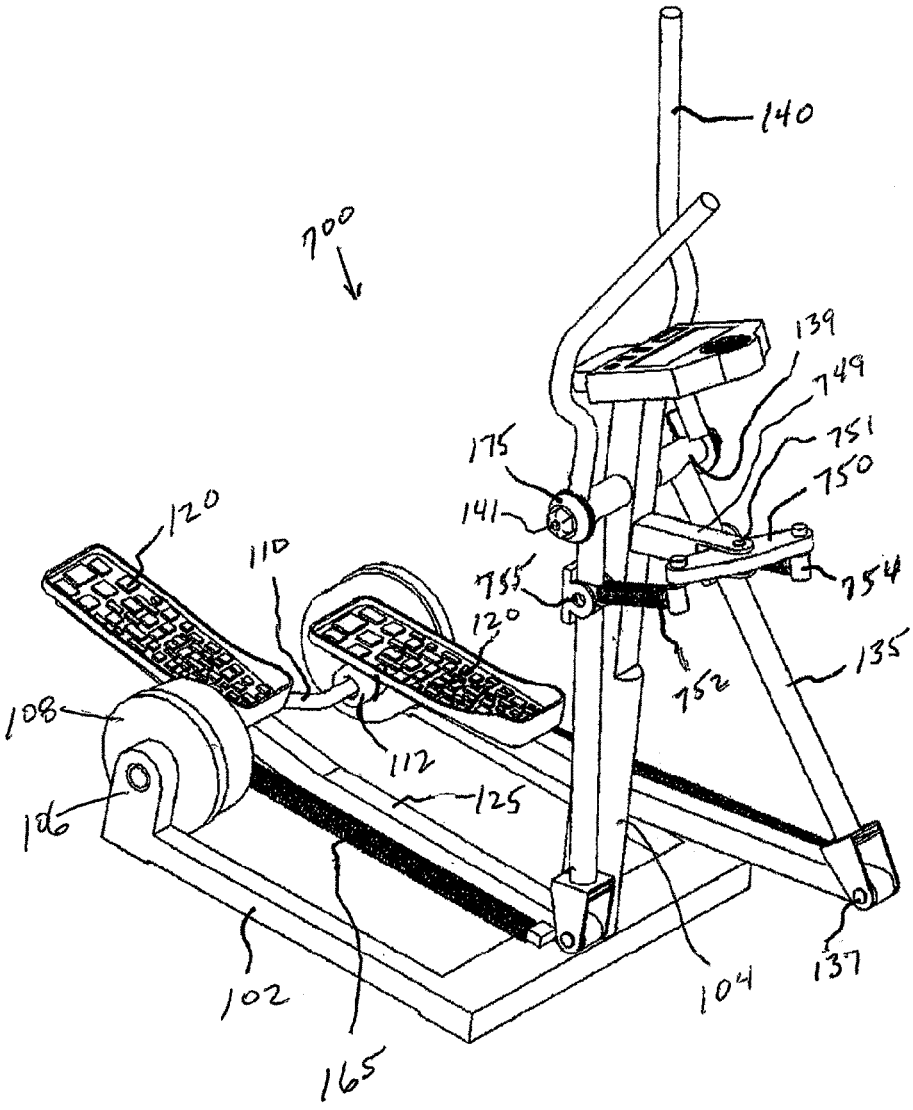
FIG. 7A is a perspective view of a seventh embodiment of an exercise apparatus.
Figure 7B:
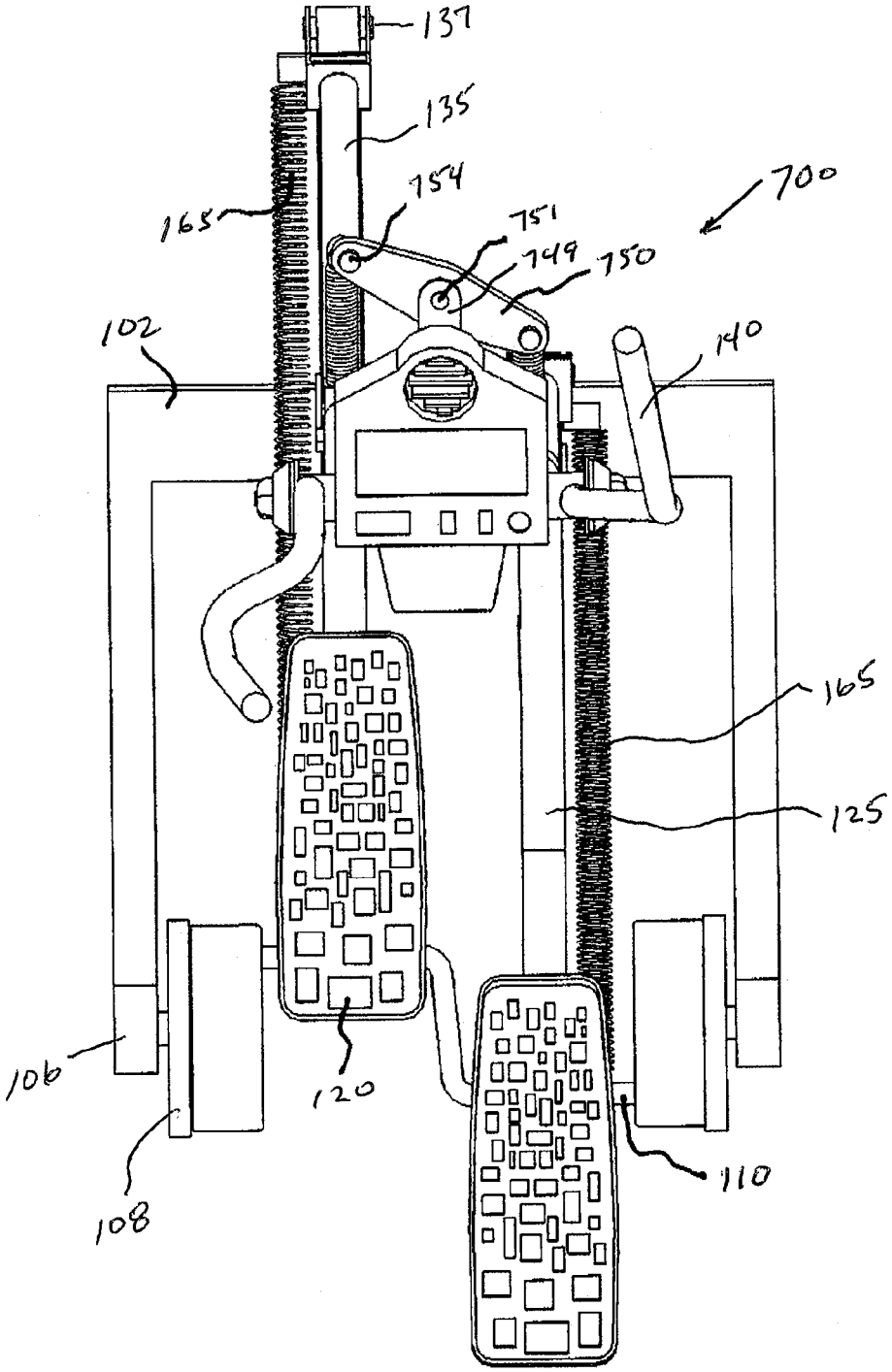
FIG. 7B is a top plan view of the exercise apparatus shown in FIG. 7A.

Referring now to FIGS. 7A and 7B, a seventh embodiment of an exercise apparatus is generally identified by the reference numeral 700. As suggested by the common reference numerals, the apparatus 700 is similar in many respects to the apparatus 100, with the exception that apparatus 700 includes a cross-connect member instead of a bevel gear to synchronize the movement of the force receiving members.

The rocker links 135 are interconnected by the cross-connect member 750 to move in dependent fashion in opposite directions relative to one another. The cross-connect member 750 is mounted on a frame member 749 that is fixed to the forward stanchion 104. The frame member 749 extends in a forward direction from the stanchion 104, away from a user standing on the foot platforms 120. The cross-member 750 is mounted proximate the distal end of the frame member 749 and is rotatable about a vertical axis defined by the bearing shaft 751. The distal ends of the cross-connect member 750 are rotatably connected to the rocker links 135 at joints 754 and 755 by a force transmitting member. In the apparatus 700 the force transmitting member is a fully collapsed spring 752. A tensile member, such as a cable or chain, may be concentrically enclosed within the spring 752 to prevent the spring 752 from expanding while at the same time permitting the spring 752 to flex. To accommodate movement in two planes, the joints 754 and 755 may be ball joints, or alternatively may be planar bearings or the like. The apparatus 700 permits variable longitudinal striding motion as a function of user applied force at the handlebars 140 and/or the foot platforms 120, and is variable depending on the deflection of springs 165.

Figure 8:
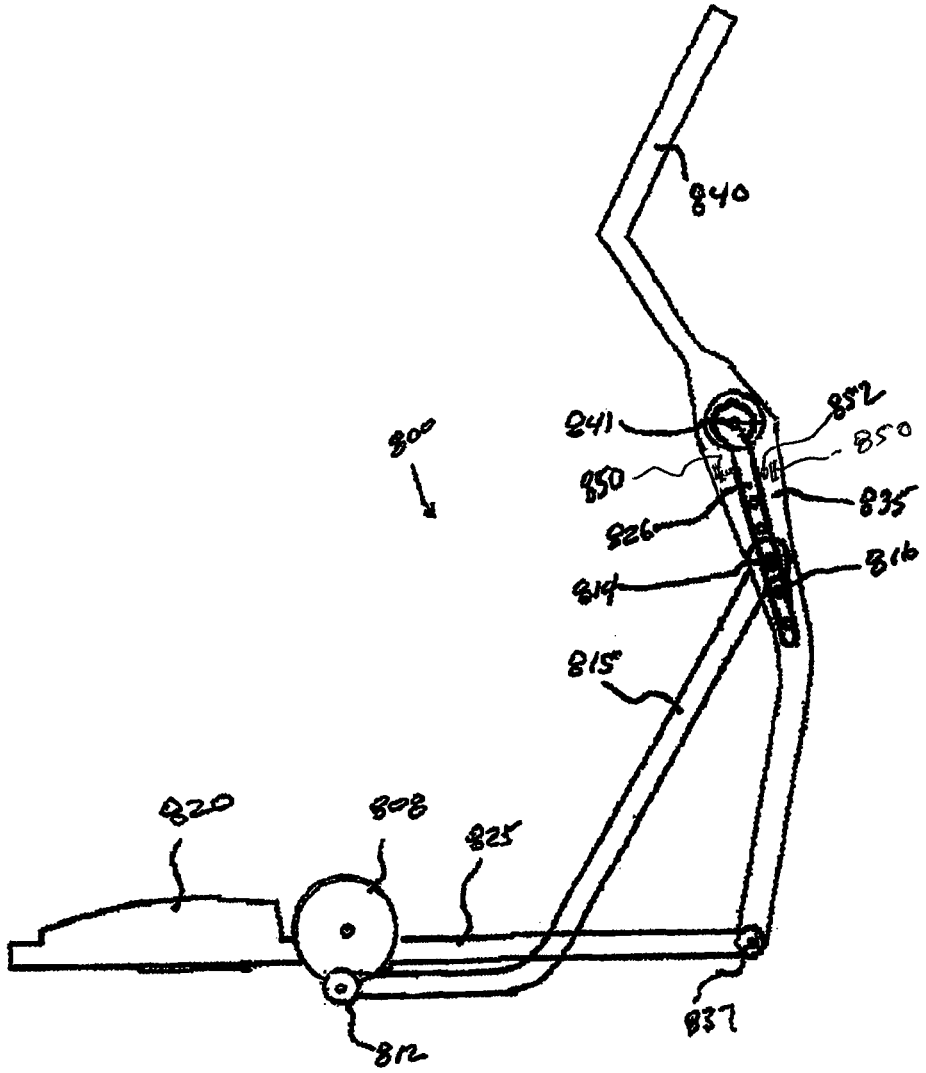
FIG. 8 is a side view of an eighth embodiment of an exercise apparatus.

Referring now to FIG. 8, an eighth embodiment of an exercise apparatus is shown, generally identified by the reference numeral 800. Only the linkage assembly of the apparatus 800 is shown in FIG. 8. Like the other embodiments described herein, the apparatus 800 may include a frame designed to rest upon a flat surface, such as a floor or the like. It is understood that a linkage assembly is movably mounted on each side of the frame. The linkage assembly may include a rocker link 835, a force receiving member 825, a drawbar rocker link 826, a drawbar 815, a crank disk 808 and a roller 812. An intermediate portion of each rocker link 835 is rotatably connected to the frame at a pivot shaft 841. An upper portion of the rocker link 835 may be configured as a handlebar 840. An upper end of the handlebar 840 may be sized and configured for grasping by a user standing on a foot platform 820 rigidly fixed to the force receiving member 825. Crank disk 808 is rotatably mounted proximate the rearward end of the frame. A crank is interconnected between crank disks 808 by means known in the art. The crank disk 808 may be connected to any of various known inertia altering devices, such as a flywheel, to provide resistance to rotation. Left and right rollers 812 are rotatably mounted on the crank for orbital movement about the crank disks 808.

Drawbar rocker link 826 is rotatably connected to the frame concentric with the rocker link 835 about the pivot shaft 841. It is understood however that the drawbar rocker link 826 may alternatively be rotatably connected to either the rocker link 835 or the frame of the apparatus 800 at an axis not collinear with the axis defined by the pivot shaft 841. A rearward distal end of the drawbar 815 may be rotatably connected to the crank 810 concentric with the crank roller 812. A forward distal end of the drawbar 815 may be rotatably connected to the drawbar rocker link 826 at pivot pin 814. The drawbar rocker link 826 may be provided with a plurality of holes 816. General stroke range adjustments may be made to the apparatus 800 by changing the connection point of the drawbar 815 to any one of the holes 816 of the drawbar rocker link 826.

Force receiving member 825 is rotatably connected to a lower distal end of the rocker link 835 at pivot 837. An underlying rearward region of the force receiving member 825 is in rolling contact with the crank roller 812, wherein the rotational axis of the crank roller 812 is collinear with the rotational axis of the rear distal end of the drawbar 815.

The rocker link 835 may be provided with blocks 850 integrally formed with the rocker link 835 or rigidly secured to the rocker link 835 by welding, bolts and the like. The blocks 850 are secured to the rocker link 835 below the pivot shaft 841 in spaced facing relationship to one another on opposite sides of the drawbar rocker link 826. Resilient members, such as compression springs 852 may be disposed in gaps defined between the blocks 850 and the drawbar rocker link 826. The springs 852 bias the drawbar rocker link 826 toward a neutral or aligned orientation relative to the rocker link 835.

Figure 9:
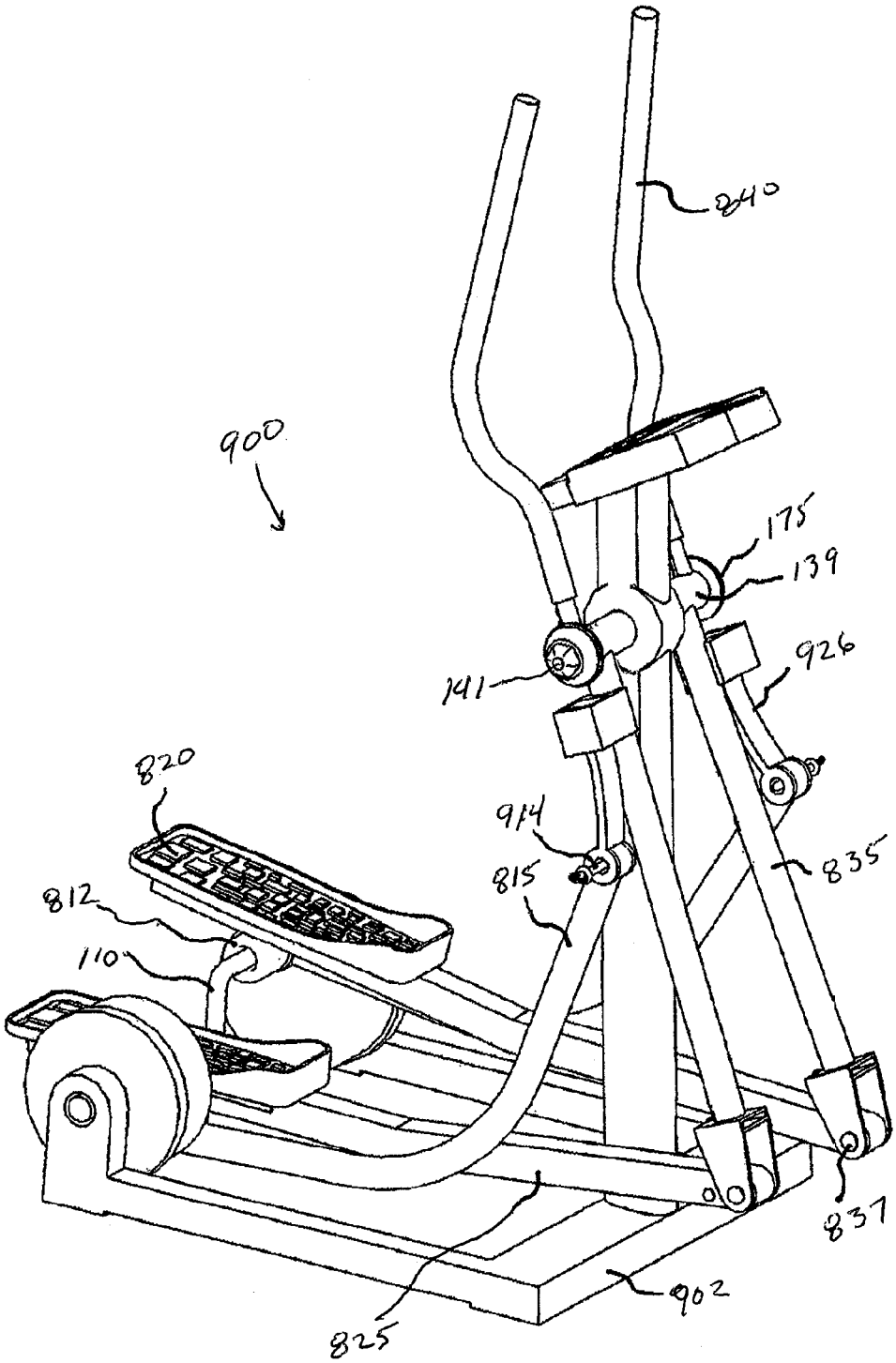
FIG. 9 is a perspective view of a ninth embodiment of an exercise apparatus.

Referring now to FIG. 9, a ninth embodiment of an exercise apparatus is generally identified by the reference numeral 900. As suggested by the common reference numerals, in many respects the apparatus 900 is similar to the apparatus 100 and 800 described above, except for the drawbar rocker 926 and the manner it is connected to the frame 902. The drawbar rocker 926 comprises a leaf spring having an upper distal end rigidly connected to rocker link 835 and a lower distal end connected to the forward distal end of the drawbar 815 at a connector 914. With this linkage arrangement, movement of the forward distal end of the drawbar 815 relative to the rocker link 835 is permitted. The relative movement is as a function the force applied by the user with his feet and/or arms. During such relative movement, the leaf spring rocker 926 would be in a state of deflection. The deflection may be in both the fore and aft directions, or alternatively, the deflection of the leaf spring rocker 926 may be limited to one direction.

While various preferred embodiments of the invention have been shown and described, other and further embodiments of the invention may be devised without departing from the basic scope thereof, and the scope thereof is determined by the claims which follow.

The invention claimed is:

1. A variable motion exercise apparatus, comprising:

a) a frame designed to rest upon a floor surface;

b) a left crank and a right crank, wherein each said crank is mounted on a respective side of said frame;

c) a left rocker link and a right rocker link, wherein each said rocker link is mounted on a respective side of said frame and rotatable about a common pivot axis, each said rocker link including a handlebar portion extending upwardly above the common pivot axis and a downwardly extending lower portion;

d) a left foot support member and a right foot support member, wherein each said foot support member is movably coupled between a respective said rocker link and a respective said crank;

e) a left drawbar link and a right drawbar link, wherein each said drawbar link includes a first distal end rotatably connected to a respective said crank and a second distal end coupled to a respective said rocker link; and f) a leaf spring interconnecting each said drawbar link and a respective said foot support member.

2. The exercise apparatus of claim 1 wherein said leaf spring is fixedly secured to a lower distal end of a respective said rocker link.

3. The exercise apparatus of claim 1 including a left drawbar rocker and a right drawbar rocker mounted on a respective side of said frame rotatable about the common pivot axis concentric with a respective said rocker link, wherein each said drawbar link is pivotally connected to a respective said drawbar rocker.

4. The exercise apparatus of claim 3 including a bracket movably mounted proximate a lower distal end of a respective said rocker link and further including a slide clamp pivotally connected to a respective said bracket, wherein a first end of each said leaf spring is connected to a respective said drawbar rocker and an opposite second end of each said leaf spring slidably engages a respective said slide clamp.

5. The exercise apparatus of claim 4 wherein each said drawbar link is pivotally connected to a lower distal end of a respective said drawbar rocker.

6. The exercise apparatus of claim 1 including an elongated spring housing pivotally connected to a lower distal end of each said rocker link, and wherein a lower distal end of each said spring housing is pivotally connected to a forward distal end of a respective said foot support member.

7. The exercise apparatus of claim 6 wherein an upper distal end of each said leaf spring is fixedly secured to a respective said rocker link, and a lower distal end of each said leaf spring is slidably received in a slide bracket mounted proximate a lower distal end of each said spring housing.

8. The exercise apparatus of claim 7 wherein each said drawbar link is pivotally connected to a respective rocker link in such a manner that said upper portion of each said rocker link is constrained to move in a fixed path, wherein the fixed path is a function of the diameter of the orbital path of each said crank.

9. The exercise apparatus of claim 3 wherein each said drawbar link is pivotally connected to a respective said drawbar rocker at a connection point that is adjustable relative to said drawbar rocker.

10. The exercise apparatus of claim 1 including a connector link interconnecting said left rocker link and said right rocker link pivotally mounted on said frame for pivoting about a transverse pivot axis to move said left and right rocker links in dependent fashion in opposite direction relative to one another.

11. The exercise apparatus of claim 1 wherein each said leaf spring comprises a drawbar leaf spring interconnecting each said drawbar link to a respective said rocker link.

12. A variable motion exercise apparatus, comprising:

a) a frame designed to rest upon a floor surface;

b) a left crank and a right crank, wherein each said crank is mounted on a respective side of said frame;

c) a left rocker link and a right rocker link, wherein each said rocker link is mounted on a respective side of said frame and rotatable about a common pivot axis, wherein each said rocker link includes a handlebar portion extending upwardly above the common pivot axis, said handlebar portion terminating in a hand grip for grasping by a user and moving a user's hands in a closed hand path, and further including a lower portion extending downwardly from proximate the common pivot axis and terminating at a lower distal end of each said rocker link;

d) a left foot support member and a right foot support member, wherein each said foot support member is movably coupled between a respective said rocker link and a respective said crank;

e) a left drawbar link and a right drawbar link, wherein each said drawbar link includes a first distal end rotatably connected to a respective said crank and a second distal end coupled to a respective said rocker link in such a manner that a foot supporting portion of each said foot support member is constrained to move through a generally elliptical foot path as a respective said crank rotates; and f) a leaf spring interconnecting each said drawbar link and a respective said foot support member for varying the configuration of the foot path and the hand path in response to user applied force to each said foot support member and/or each said rocker link.

* * * * *